US005340956A

United States Patent [19]

Chen

[11] Patent Number: 5,340,956

[45] Date of Patent: Aug. 23, 1994

[54] KEY SWITCH

[75] Inventor: Castle Chen, Taipei, Taiwan

[73] Assignee: Silitek Corporation, Taipei, Taiwan

[21] Appl. No.: 14,975

[22] Filed: Feb. 10, 1993

[51] Int. Cl.[5] ..... H01H 3/12

[52] U.S. Cl. ..... 200/341; 200/512

[58] Field of Search ..... 200/341, 512, 345, 517, 200/275, 513, 514, 515, 516, 342, 343; 264/274, 242, 255

[56] References Cited

U.S. PATENT DOCUMENTS

| | | | |
|---|---|---|---|
| 4,336,920 | 6/1982 | Murray | 264/274 |
| 4,609,791 | 9/1986 | Abbat | 200/517 |
| 4,862,499 | 8/1989 | Jekot et al. | 200/512 |
| 5,081,329 | 1/1992 | Mitusinski et al. | 200/314 |
| 5,107,083 | 4/1992 | Yagi | 200/341 |

*Primary Examiner*—Ernest G. Cusick
*Assistant Examiner*—David J. Walczak
*Attorney, Agent, or Firm*—Lowe, Price, LeBlanc & Becker

[57] ABSTRACT

Disclosed is a key switch formed by molding a silicone rubber key base to a rubber key body, wherein the rubber key body has a neck portion in the middle and a center recess on a bottom surface thereof for bonding the silicone rubber key base through a low-pressure, low-temperature molding process; the silicone rubber key base has a short plunger supported within a circular sloping wall portion at a higher elevation for touch control and quick return.

1 Claim, 5 Drawing Sheets

KEY SWITCH

BACKGROUND OF THE INVENTION

The present invention relates to key switches, and more particularly the present invention relates to a key switch comprised of a silicone rubber key base directly molded on a rubber key body at the bottom.

A variety of automatic machines and telecommunication equipment are known and widely used in different fields to serve people. These machines and equipment are generally controlled through a key-switch control panel. Various types of key switches have been proposed for use in these machines and equipment. A normal key switch generally comprises a spring or elastomer for key cap automatic return control. Because the spring or elastomer is separately prepared and installed, the cost of the key switch is relatively increased, and the assembly process is complicated.

SUMMARY OF THE INVENTION

The present invention has been accomplished under the aforesaid circumstances. It is therefore an object of the present invention to provide a key switch which is simple in structure, and inexpensive to manufacture. It is another object of the present invention to provide a key switch which is comfortable in touch, and provides high accuracy in operation. It is still another object of the present invention to provide a key switch which is unitarily molded, and therefore durable in use.

According to the preferred embodiment of the present invention, the key switch is generally comprised of a silicone rubber key base directly molded to a rubber key body under low temperature (about 120° C. to 150° C.) and low pressure. The hardening time is about 20 to 30 seconds. The rubber key body has a neck portion in the middle and a center recess on a bottom surface thereof for bonding the silicone rubber key base tightly. The silicone rubber key base has a short plunger supported within a circular sloping wall portion at a higher elevation for touch control and quick return.

DETAILED DESCRIPTION OF THE PREFERRED EMBODIMENT

Figure 1:
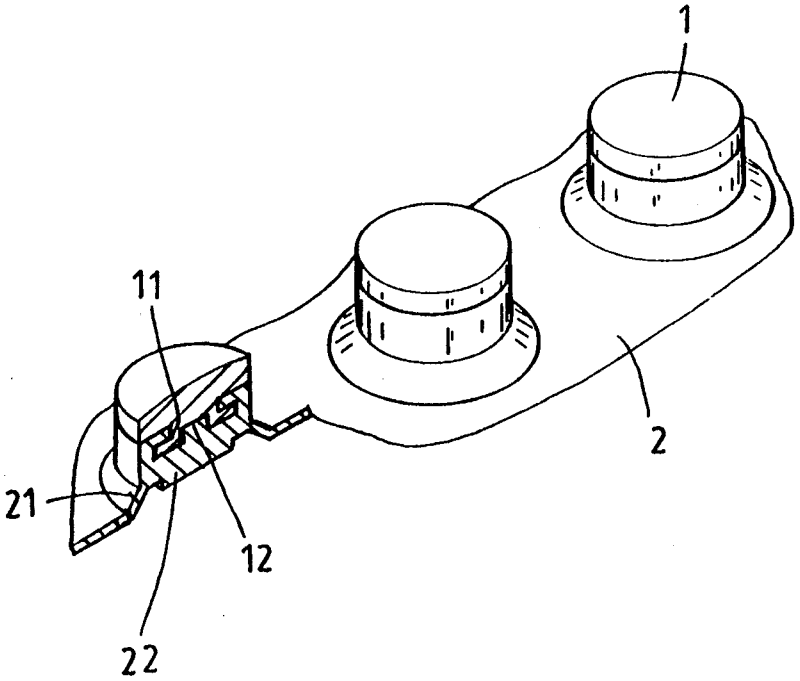
FIG. 1 is a perspective and partial cut-off view of the key switch of the preferred embodiment of the present invention.

Referring to FIG. 1, a key switch in accordance with the present invention is generally comprised of at least one rubber key body 1, and a silicone rubber key base 2. The rubber key body 1 is made in a short, stepped cylinder having a neck portion 11 in the middle and a center recess 12 on the bottom surface of the shorter diameter portion thereof for bonding the silicone rubber key base 2.

Figure 2:
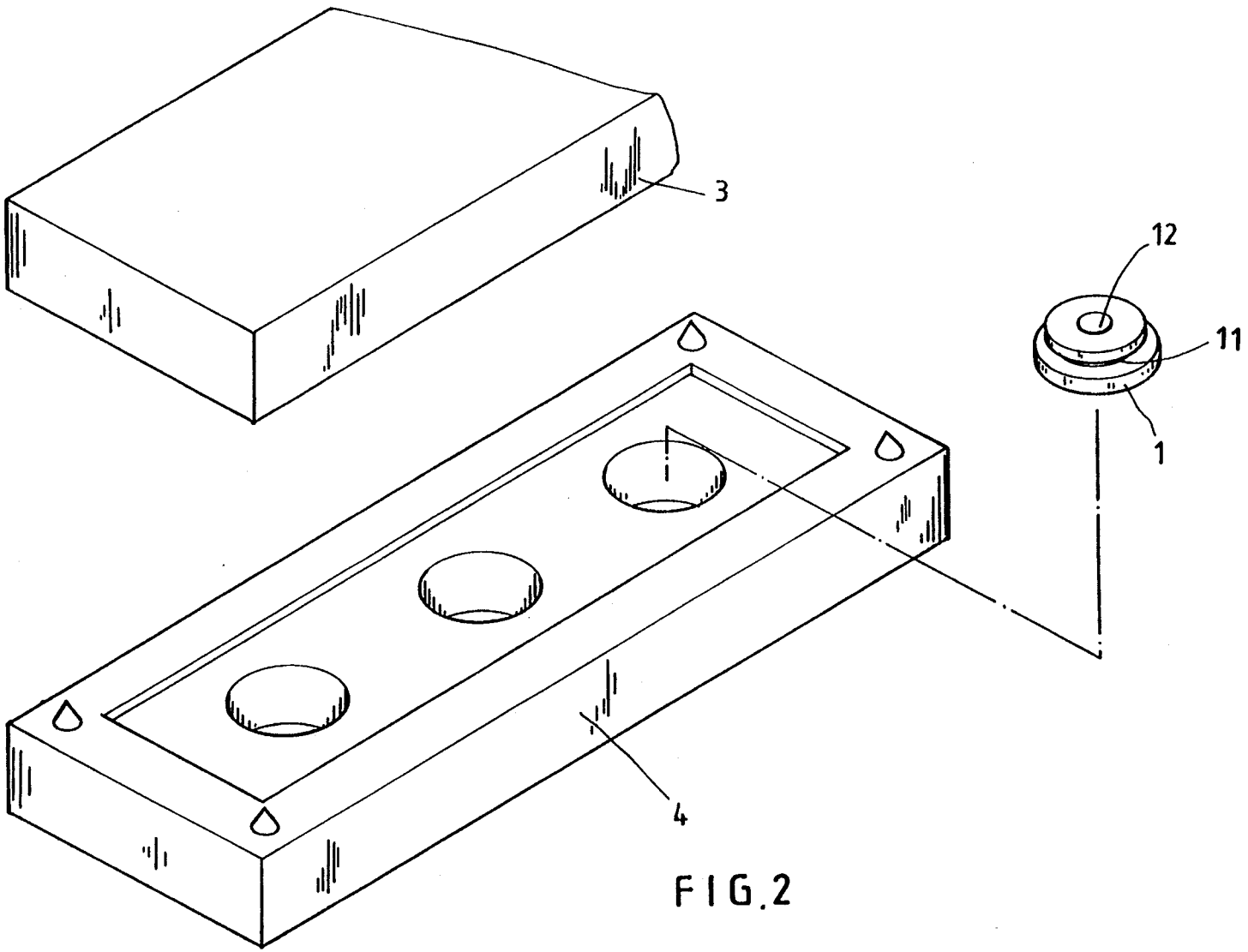
FIG. 2 is an dismantled view of a mold according to the present invention, showing the cavity in which the rubber key body is to be inserted.
Figure 3:
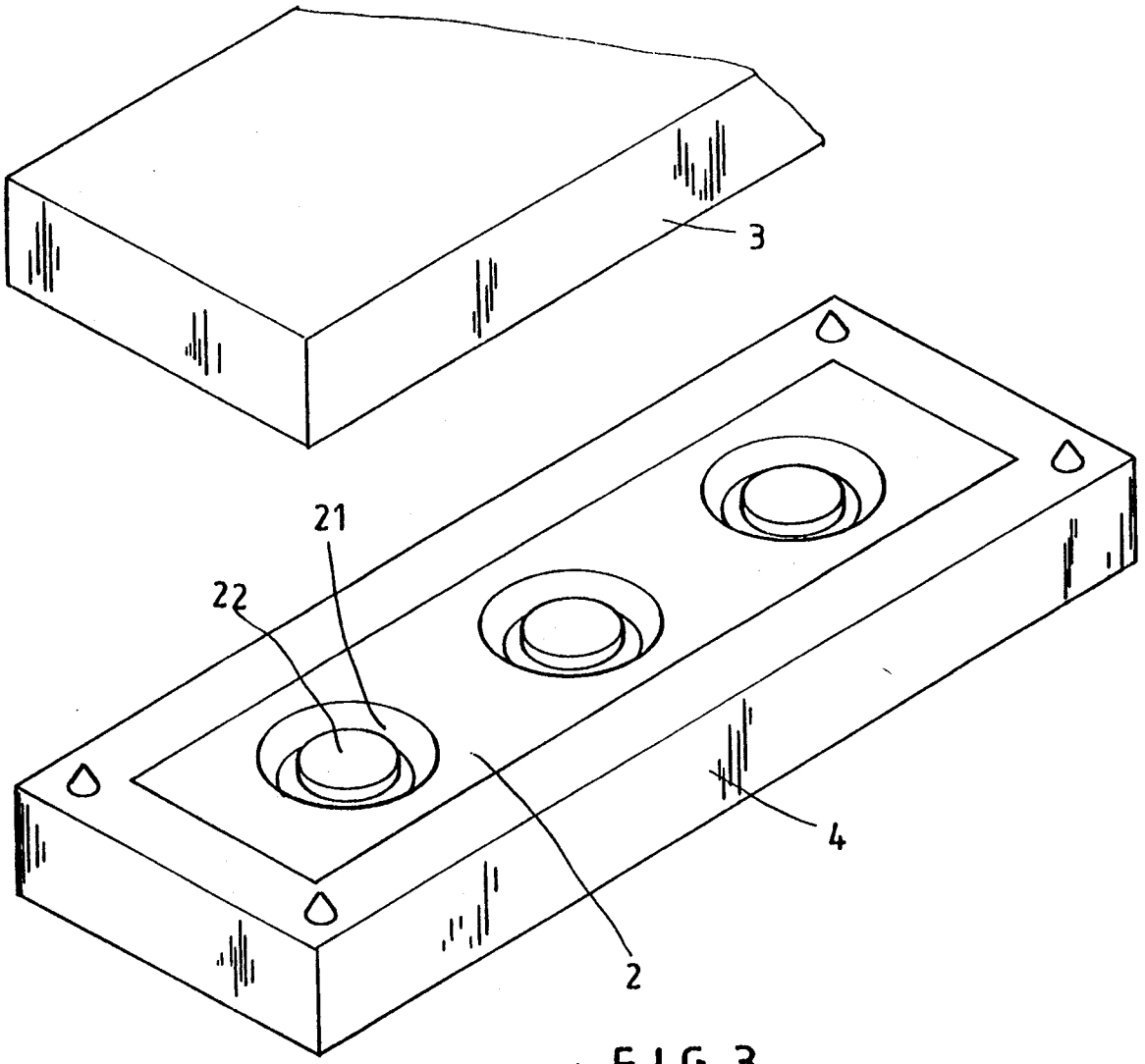
FIG. 3 is another dismantled view of the mold of FIG. 2, showing a silicone rubber key base molded in each cavity.
Figure 4:
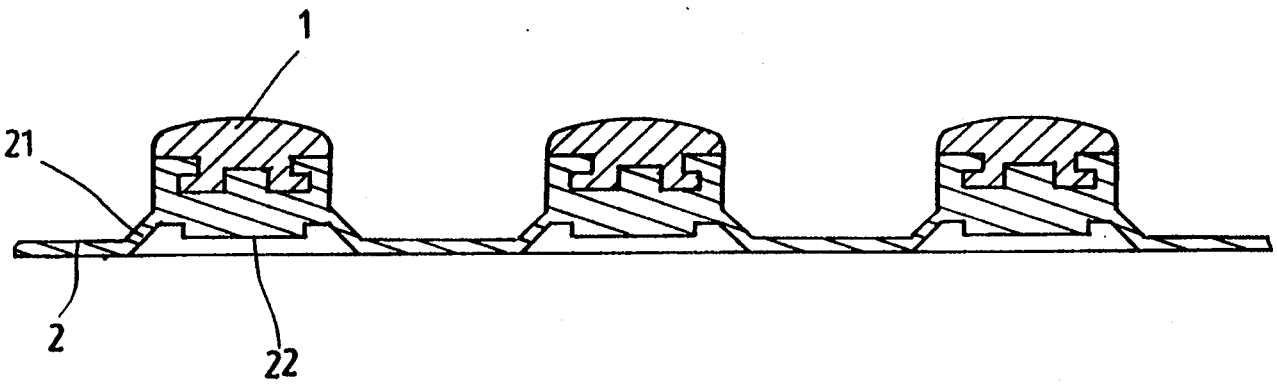
FIG. 4 is a sectional elevation showing the respective sloping surface portion and short plunger connected to the respective rubber key body.

Referring to FIGS. 2, 3 and 4, a rubber key body 1 each is respectively is inserted in the respective cavity of the mold 3 and 4, then the mold 3 and 4 is filled with a liquefied silicone rubber and treated under low pressure and low temperature. When hardened, a silicone rubber key base 2 is formed and unitarily molded to each rubber key body 1. When molded, as illustrated in FIG. 4, a respective short plunger 22 is formed within a respective circular sloping wall portion 21 connected to the respective rubber key body 1 at the bottom.

Figure 5A:
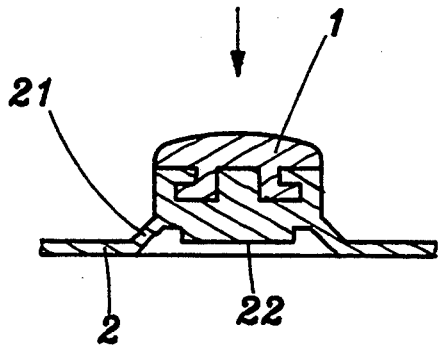
FIG. 5(A) illustrates the position of the short plunger before pressing.
Figure 5B:
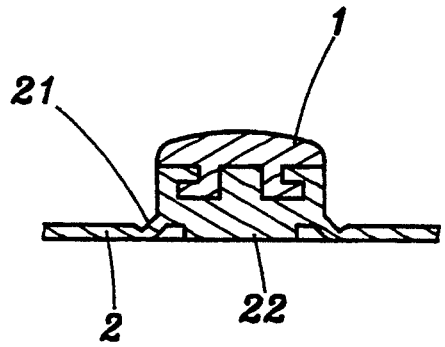
FIG. 5(B) illustrates the position of the short plunger when pressed.

Referring to FIG. 5(A), when assembled, the plunger 22 is supported on the circular sloping wall portion 21 above the printed circuit board below. Referring to FIG. 5(B), pressing the key body 1 causes the plunger 22 to touch the respective contact on the circuit of the printed circuit board below. The circular sloping wall portion 21 automatically moves the plunger 22 and the key body 1 back to their former positions as the key body 1 is released.

While only one embodiment of the present invention has been shown and described, it will be understood that various modifications and changes could be made without departing from the basic teachings of the invention. For example, the key switch may be made in any of a variety of shapes and sizes according to different purposes.

What is claimed is:

1. A key switch comprising a rubber key body and an integral silicone rubber base molded to said rubber key body, said key body having an upper, flattened striking surface, a lower surface and a cylindrical neck axially mounted on the lower surface and depending therefrom and having an outwardly protruding distal base surface disposed perpendicularly to a longitudinal axis thereof, said base surface defining a central recess, said neck further defining a circumferential groove formed between the lower surface of said key body and an upper surface of said protruding distal base; and said silicone rubber key base comprising an upper and a lower portion, the lower portion forming a downwardly opening recess defined by a circular sloping wall and a plunger disposed centrally therein said plunger having a distal bottom edge disposed at a higher elevation than a lower surface of said lower portion, the upper portion of said key base defining a mounting cylinder extending axially upwardly from said plunger, an upper portion of said mounting cylinder being integrally molded to the lower surface of said key body so as to receive said neck therein and thereby fill the groove and recess thereof, said key base being molded to said key body under low pressure and temperature.

* * * * *